US005083681A

United States Patent [19]

Nye

[11] Patent Number: 5,083,681

[45] Date of Patent: Jan. 28, 1992

[54] VALVE FOR A FLUID DISPENSING CONTAINER

[76] Inventor: Norman H. Nye, 1348 Highbridge Rd., Cuyahoga Falls, Ohio 44223

[21] Appl. No.: 551,765

[22] Filed: Jul. 12, 1990

[51] Int. Cl.[5] ..... B65D 83/14

[52] U.S. Cl. ..... 222/153; 222/182; 222/402.11; 222/402.13; 222/402.24; 222/509; 222/518

[58] Field of Search ..... 222/94, 153, 509, 559, 222/182, 402.1, 402.11, 402.23, 518, 402.12, 402.13, 402.24; 251/340, 348

[56] References Cited

U.S. PATENT DOCUMENTS 2,766,913 10/1956 Wilshusen ..... 222/402.12
3,318,492 5/1967 Haas ..... 222/402.11
3,490,658 1/1970 Schwartzman ..... 222/402.12
3,782,603 1/1974 McConnell et al. ..... 222/153
4,423,829 1/1984 Katz .
4,437,592 3/1984 Bon ..... 222/509 X
4,477,001 10/1984 Galia ..... 222/402.1

*Primary Examiner*—Kevin P. Shaver
*Attorney, Agent, or Firm*—Oldham & Oldham Co.

[57] ABSTRACT

Valve for a fluid dispensing container. The valve comprises a hollow valve body having a nozzle extending axially in one direction therefrom. At the discharge end of the nozzle is a valve seat in the shape of a frustum with the largest diameter of the frustum being at the tip end of the nozzle, and a normally closed axially moveable valve member that seats on the valve seat so as to prevent discharge of fluid. The valve also includes an axially moveable valve stem connected to the valve member, and a moveable actuating ring encircling the valve body and connected to the valve stem so that movement of the actuating ring causes axial movement of the valve stem and valve member to open the valve.

7 Claims, 3 Drawing Sheets

VALVE FOR A FLUID DISPENSING CONTAINER

BACKGROUND OF THE INVENTION

This invention relates generally to self pressurized dispensing fluid containers. It is for a valve that is intended to dispense fluids and pasty materials at low pressure from the types of containers in which the discharge pressure is provided for by means of an elastic sleeve. Such a container is described in a U.S. Pat. No. 4,423,829 that was issued to Hyman Katz.

In the past most self pressurized containers have been of the aerosol type in which the dispensing pressure was provided for by means of a gas. In order that there was enough gas in the container to completely discharge all the contents of the container, it was necessary to use a gas that could be put under enough pressure to maintain it as a liquid while it was in the container but it would become a gas when the pressure was reduced by the opening of the discharge valve.

There has not been a low cost gas available that would operate as desired at quite low pressures and most available gases that have been used in aerosol containers have been environmentally unsatisfactory or are dangerous to use.

Because it was necessary to use rather high pressures in the aerosol containers, the contents of the container came out usually as a squirt or a spray. Most of the valves that have been used have been designed for higher pressures and usually have very fine orifices in order to properly control the high pressures and therefore such containers have been limited to handling thin liquids or very fine dispersions.

The type of container that uses an elastic sleeve for the pressurizing energy as is described in the Katz patent has the unique advantage that any desired pressure down to almost zero can be obtained by simply making the elastic sleeve with the required thickness.

There are many products that should flow easily out of a container rather than squirting or spraying; for instance, the products could be foods such as catsup, mustard, salad dressing, etc. or non-foods, such as toothpaste, soap, lubricants and many other materials.

SUMMARY OF THE INVENTION

This invention provides a valve mechanism that is particularly advantageous for low pressure applications. It has large passageways for for handling coarse materials; it has an easily actuated ring that anyone, even a child, can control; it has the valve seat at the tip of the nozzle so that when the valve is closed there is no residue of material trapped and exposed so as to become congealed or contaminated. The frustum shape of the valve member that has the large diameter at the outside allows for the provision of a cap that can hold the valve closed for shipping and handling, and a skirt can be provided if necessary to protect the actuating ring.

DETAILED DESCRIPTION OF THE INVENTION

Figure 1:
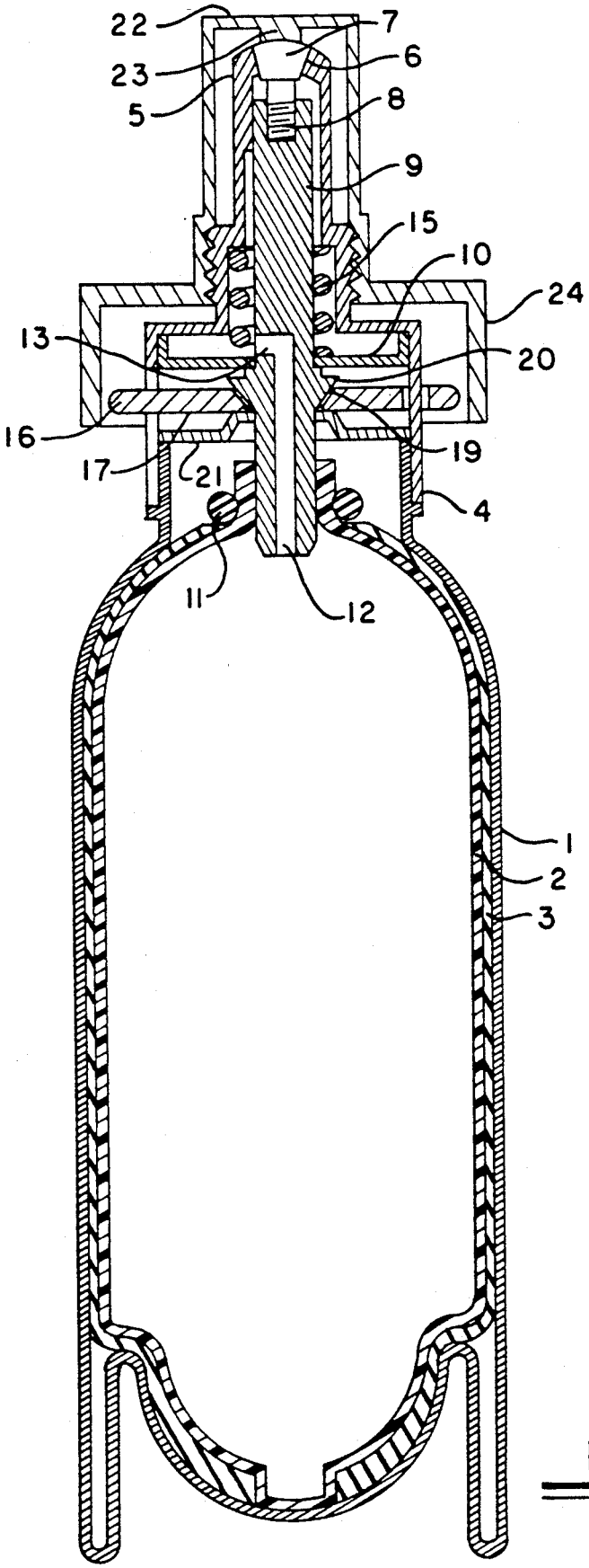
FIG. 1 is an enlarged section showing a container and a valve such as has been described. The container is shown in the state it would be in if it was filled to full capacity and the valve was closed and held inoperative by means of a protective cap.

Referring to the drawings a container is shown in FIG. 1 that consists of a shell (1), an elastic sleeve (2) and an inner liner (3). The liner (3) contains the product that is to be dispensed and is usually pleated when empty but is shown as filled and expanded to its full capacity. A valve body (4) is shown attached to shell (1). A discharge nozzle (5) is formed integrally with valve body (4).

The discharge end of the nozzle (5) contains internally a female valve seat (6) that has the shape of a frustum with the largest diameter of the frustum shape being at the outer tip discharge end of the nozzle (5). A male valve member (7) that also has the shape of a frustum that conforms to the shape of the female valve seat (6) has a threaded stud (8) integral with it that is screwed into a valve stem (9). The male valve member (7) is normally held in tight contact with the female valve seat (6) to close the valve. A flexible diaphragm (10) is provided and is sealed liquid tight by press fits to valve stem (9) and valve body (4). The valve stem (9) is pressed into the liner (3) and if it is needed to preserve liquid tightness, a retaining ring (11) can be used. Passageway for the contents of the container to pass from the interior of liner (3) to the discharge valve is through a hole (12) and orifice (13) in the valve stem (9) and through a chamber defined between diaphragm (10) and valve body (4) and through the annular space that is between the valve stem (9) and nozzle (5).

A valve spring (15) normally causes pressure on the male valve member (7) to hold the valve closed. An actuating ring (16) encircles the outside of the valve body (4) and has extensions through slots in valve body (4) to connect integrally with a disc (17) that is in the interior of the valve body (4) and has a countersunk hole (19) through which the valve stem (9) extends. The valve stem (9) has integral with it a cone shaped collar (20) that is placed inside of hole (19) in such a way that radial motion of the actuating ring (16) and disc (17) will produce by cam action an axial movement of the valve stem (9) and male valve member (7) to open the valve.

A plate (21) is provided that has a raised portion (**21*a*) at its center that supports disc (17) with its actuating ring (16). The raised portion (22*a*) of plate (21) acts as a lever fulcrum so that if actuating ring (16) with disc (17) is tilted a leverage action takes place to axially move valve stem (9) and male valve member (7**) to also open the valve.

The valve body (4) may, and usually will, be provided with a threaded portion (21) on which a protective cap (22) will be screwed. The protective cap (22) may have an extension (23) that contacts the male valve member (7). When the protective cap (22) is tightly screwed in place, the valve cannot be opened during the shipping and handling of the container. A protective skirt (24) may be provided that is attached to, or is a part of, protective cap (22) for partially surrounding the actuating ring (16) to prevent inadvertent operation of, or damage to, the actuating ring (16).

The valve that is herein described is not intended to be used only with the type of container shown here. It could be used in conjunction with different types of containers even if the discharge pressure is the force of gravity.

What is claimed:

1. A valve for a fluid dispensing container comprising:

(a) a valve body having means for attaching to a container;

(b) a nozzle attached to said valve body for directing a fluid discharge from the said container, said nozzle having at the discharge end a female valve seat that has the shape of a frustum, the largest diameter of the said frustum being at the outermost end of the discharge end of the said nozzle;

(c) a male valve member having an end that corresponds in shape to, and disposed at the said female valve seat and that is normally held in contact with the said female valve seat by biasing means so as to prevent discharge of fluid from the said container but is capable of being moved axially to open the valve and allow the discharge of fluid;

(d) a moveable actuating ring encircling the valve body, and cooperating means connecting the said actuating ring with the said male valve member so that movement of the said actuating ring will open the valve.

2. A valve for a fluid dispensing container comprising:

(a) a valve body adapted to be attached to a container;

(b) a nozzle attached to said valve body for directing a fluid discharge from the said container, said nozzle having at the discharge end a female valve seat that has the shape of a frustum, the largest diameter of the said frustum being at the outermost end of the discharge end of the said nozzle;

(c) a male valve member that corresponds in shape to, and disposed at the said female valve seat;

(d) a valve stem connected to the said male valve member;

(e) spring means for normally holding the said valve member in contact with the said female valve seat to close the valve and prevent discharge of the contents of the said container, the said male valve member being capable of moving axially to open the valve; and (f) a moveable actuating ring encircling the said valve body, means associated with the said valve stem and said actuating ring such that movement of the said actuating ring causes axial movement of the said male valve member to open the valve.

3. A valve according to claim 2 further including a protective cap that includes means for putting pressure on the said male valve member to hold it tight against the female valve seat so as to prevent the opening of the valve.

4. A valve according to claim 2 further including a protective cap that has a skirt that partially surrounds the said actuating ring and that protects the said actuating ring from being inadvertently operated or damaged.

5. A valve according to claim 2, wherein said valve body and said nozzle are hollow, said valve stem is axially moveable inside said valve body and said nozzle, and said stem has passageway means extending therethrough for providing fluid communication from the interior of said container to said nozzle.

6. A valve according to claim 2, wherein (1) said valve body, said nozzle and said valve stem are essentially cylindrical and coaxial; (2) said nozzle extends axially in one direction from said valve body; and (3) said valve stem is axially moveable inside said valve body and said nozzle, said valve stem having passageway means extending therethrough for providing fluid communication from the interior of said container to said nozzle.

7. A valve according to claim 6 wherein said container has an opening and said valve stem is adapted to be inserted into said opening in fluid tight relationship therewith.

* * * * *

UNITED STATES PATENT AND TRADEMARK OFFICE

CERTIFICATE OF CORRECTION

PATENT NO. : 5,083,681

DATED : January 28, 1992

INVENTOR(S) : Norman H. Nye

Figure 2:
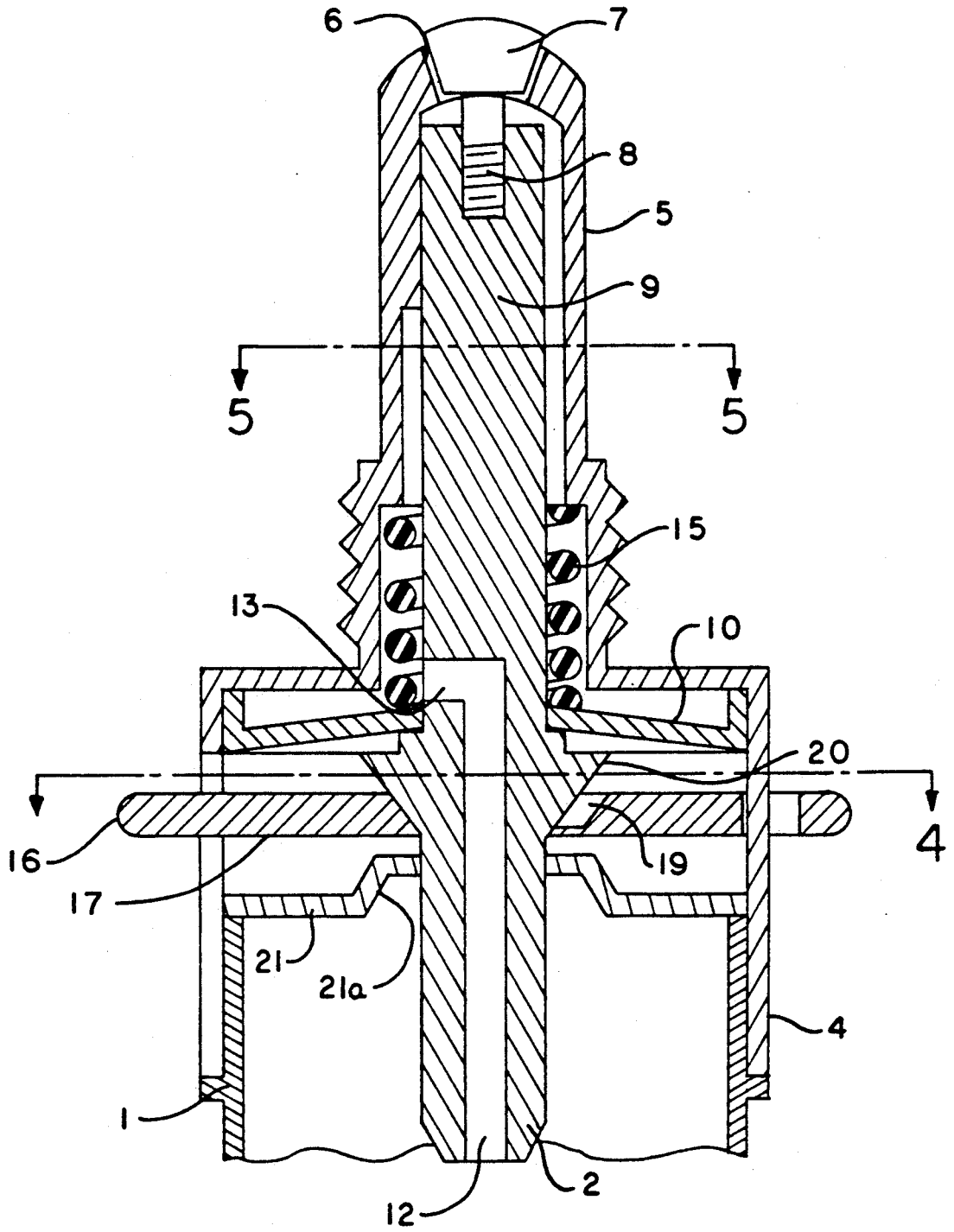
FIG. 2 shows a partial enlarged section of the valve as if it has been opened for discharge by means of the movement of an actuating ring that has been moved in a radial direction only.
Figure 3:
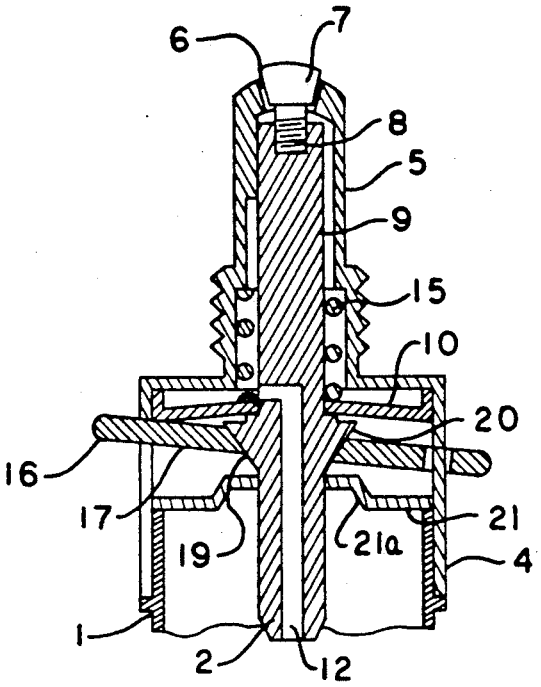
FIG. 3 shows a partial enlarged section of the valve as if it has been opened for discharge by the tilting of an actuating ring.
Figure 4:
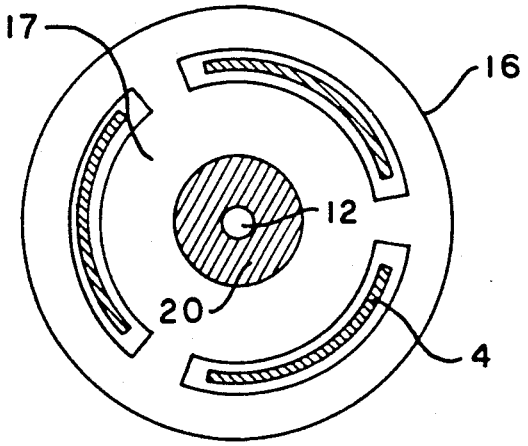
FIG. 4 is a section taken on line 4,4 of FIG. 1.
Figure 5:
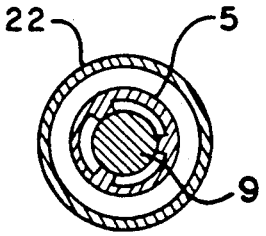
FIG. 5 is a section taken on line 5,5 of FIG. 1.
Figure 2:
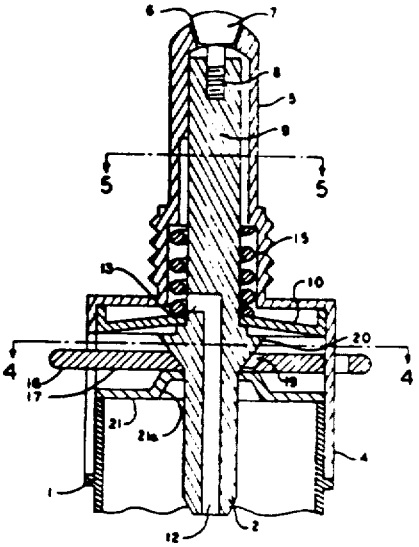
Figure 3:
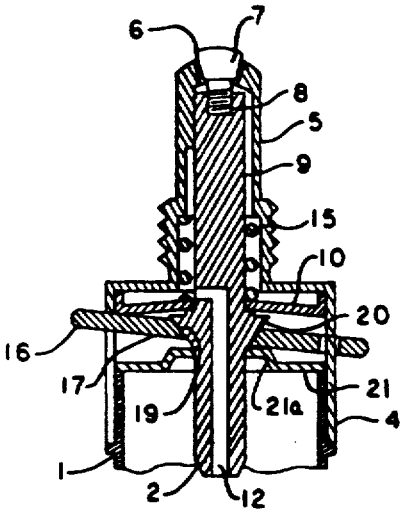

It is certified that error appears in the above-identified patent and that said Letters Patent is hereby corrected as shown below:

The sheet of drawing, consisting of figures 2 and 3, should be deleted to be replaced with the attached page.

Signed and Sealed this

Seventeenth Day of August, 1993

*Attest:*

*Attesting Officer*

BRUCE LEHMAN

*Commissioner of Patents and Trademarks*